US008763532B2

(12) United States Patent
Wang et al.

(10) Patent No.: US 8,763,532 B2
(45) Date of Patent: Jul. 1, 2014

(54) DEVICES AND METHODS FOR PERFORATING A WELLBORE

(71) Applicants: Zeping Wang, Katy, TX (US); Dan Pratt, Benbrook, TX (US); Paul Noe, Benbrook, TX (US)

(72) Inventors: Zeping Wang, Katy, TX (US); Dan Pratt, Benbrook, TX (US); Paul Noe, Benbrook, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 13/915,083

(22) Filed: Jun. 11, 2013

(65) Prior Publication Data

US 2013/0270003 A1 Oct. 17, 2013

Related U.S. Application Data

(62) Division of application No. 12/406,278, filed on Mar. 18, 2009, now Pat. No. 8,459,186.

(60) Provisional application No. 61/037,979, filed on Mar. 19, 2008.

(51) Int. Cl.

| | |
|---|---|
| ***F42B 1/032*** | (2006.01) |
| ***F42B 1/028*** | (2006.01) |
| ***F42B 3/08*** | (2006.01) |
| ***E21B 43/117*** | (2006.01) |

(52) U.S. Cl.
USPC ..... 102/307; 102/306; 175/4.6; 89/1.15

(58) Field of Classification Search
CPC ..... F42B 1/02; F42B 1/028; F42B 1/032; F42B 3/08; E21B 43/117
USPC ..... 102/306, 307, 308, 309, 310, 476; 175/4.6; 89/1.15
See application file for complete search history.

(56) References Cited

U.S. PATENT DOCUMENTS

| | | | | |
|---|---|---|---|---|
| 3,077,834 | A | 2/1963 | Caldwell | |
| 3,269,467 | A | 8/1966 | Bell | |
| 4,499,830 | A | 2/1985 | Majerus et al. | |
| 4,702,171 | A | 10/1987 | Tal et al. | |
| 5,251,561 | A | 10/1993 | Murphy | |
| 5,522,319 | A | 6/1996 | Haselman, Jr. | |
| 6,305,289 | B1 | 10/2001 | Mayseless et al. | |
| 6,349,649 | B1 | 2/2002 | Jacoby et al. | |
| 6,510,796 | B2 | 1/2003 | Mayseless et al. | |
| 8,156,871 | B2 * | 4/2012 | Behrmann et al. | 102/476 |
| 2001/0052303 | A1 | 12/2001 | Mayseless et al. | |
| 2002/0017214 | A1 | 2/2002 | Jacoby et al. | |

FOREIGN PATENT DOCUMENTS

| | | | |
|---|---|---|---|
| DE | 2927556 | C1 | 5/1985 |
| DE | 3111921 | C1 * | 5/1985 |
| WO | 2009117548 | A1 | 9/2009 |

* cited by examiner

*Primary Examiner* — James Bergin
(74) *Attorney, Agent, or Firm* — Mossman, Kumar & Tyler, PC

(57) ABSTRACT

An apparatus and method for perforating a subterranean formation is disclosed. The apparatus includes a tubular carrier; a charge tube disposed in the tubular carrier; and at least one shaped charge mounted in the charge tube which includes a casing, an explosive material and a liner enclosing the explosive material within the casing. An apex portion of the liner has a cross-sectional thickness greater than a cross-sectional thickness of any other portion of the liner. The cross-sectional thickness of the apex portion may be at least fifty percent thicker than a cross-section of a portion adjacent the apex portion. A density of the apex portion may be greater than the density of any other portions of the liner.

6 Claims, 5 Drawing Sheets

DEVICES AND METHODS FOR PERFORATING A WELLBORE

CROSS-REFERENCE TO RELATED APPLICATIONS

This application is a divisional of Ser. No. 12/406,278, filed Mar. 18, 2009, now U.S. Pat. No. 8,459,186, which claims priority from U.S. Provisional Application No. 61/037,979, filed Mar. 19, 2008, the contents of which are incorporated by reference for all purposes.

BACKGROUND OF THE DISCLOSURE

1. Field of the Disclosure

The present disclosure relates to devices and methods for perforating a formation.

2. Description of the Related Art

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

Shaped charges used in perforating oil wells and the like typically include a housing which is cylindrical in shape and which is formed from metal, plastic, rubber, etc. The housing has an open end and receives an explosive material having a concave surface facing the open end of the housing. The concave surface of the explosive material is covered by a liner which functions to close the open end of the housing. When the explosive material is detonated, a compressive shock wave is generated which collapses the liner. The inner portion of the liner is extruded into a narrow diameter high-speed jet which perforates the casing and the surrounding cement comprising the oil well, etc. The remainder at the liner can form a larger diameter slug which can follow the high-speed jet into the perforation, thereby partially or completely blocking the perforation and impeding the flow of oil therethrough.

While shaped charges have been in use for oilfield applications for decades and the behavior and dynamics of the jets formed by shaped charges have been extensively studied, traditional shaped charge designs do not yet take full advantage of the amount of explosive used and/or the amount of liner available to form a jet. The present disclosure addresses these and other drawbacks of the prior art.

SUMMARY OF THE DISCLOSURE

The present disclosure provides an apparatus for perforating a subterranean formation. The apparatus includes a tubular carrier; a charge tube disposed in the tubular carrier; and at least one shaped charge mounted in the charge tube. The shaped charge includes a casing; an explosive material in the casing; and a liner enclosing the explosive material within the casing. The liner includes an apex portion having a cross-sectional thickness greater than a cross-sectional thickness of any other portion of the liner. In one aspect, the cross-sectional thickness of the apex portion is at least fifty percent thicker than a cross-section of a liner portion adjacent the apex portion. In another aspect, a material density of the apex portion is greater than the material density of any other portion of the liner. The liner (having axial length L) may include a first region having the apex portion and a second region having a skirt portion, wherein the first region and the second region each make up substantially one-half of the axial length of the liner, and wherein the first region has more mass than the second region. In one aspect the explosive material adjacent the liner is distributed to reduce a pressure generated in a region proximate the apex.

The present disclosure further provides a method of perforating a subterranean formation. A shaped charged is conveyed into a wellbore penetrating the formation, the shaped charged including a casing, an explosive material in the casing, and a liner enclosing the explosive material within the casing, the liner including an apex portion having a cross-sectional thickness greater than a cross-sectional thickness of any other portion of the liner. The shaped charge is then detonated. In one aspect, the cross-sectional thickness of the apex portion is at least fifty percent thicker than a cross-section of a liner portion adjacent the apex portion. In another aspect, a material density of the apex portion is greater than the material density of any other portion of the liner. The liner (having an axial length L) may include a first region having the apex portion and a second region having a skirt portion, wherein the first region and the second region each make up substantially one-half of the axial length of the liner; and wherein the first region has more mass than the second region. In one aspect, the explosive material adjacent the liner is distributed to reduce a pressure generated in a region proximate the apex. The shaped charge may be conveyed in the wellbore using one of: (i) a coiled tubing, (ii) a drill pipe, (iii) a wireline, and (iv) a slick line.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the exemplary embodiment, taken in conjunction with the accompanying drawings, in which like elements have been given like numerals and wherein.

DESCRIPTION OF THE DISCLOSURE

Figure 1A:
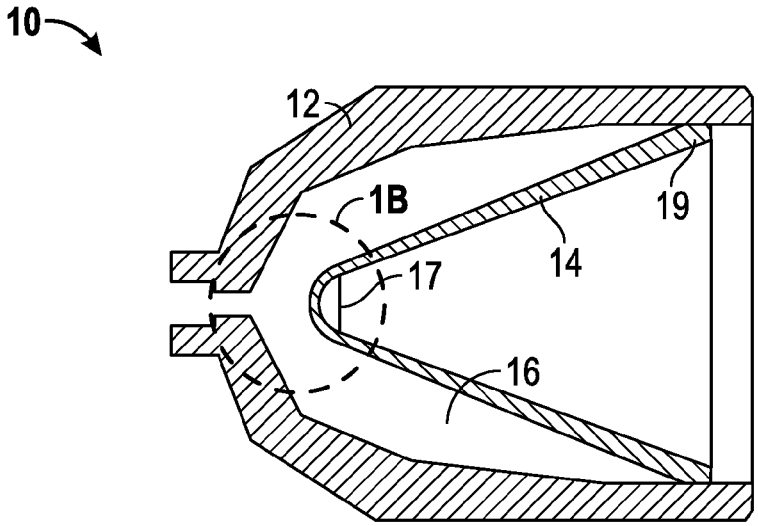
FIG. 1A (Prior Art)
FIGS. 1A and 1B illustrate cross-sectional views of a traditional shaped charge design.

The present disclosure relates to devices and methods for perforating a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Figure 1B:
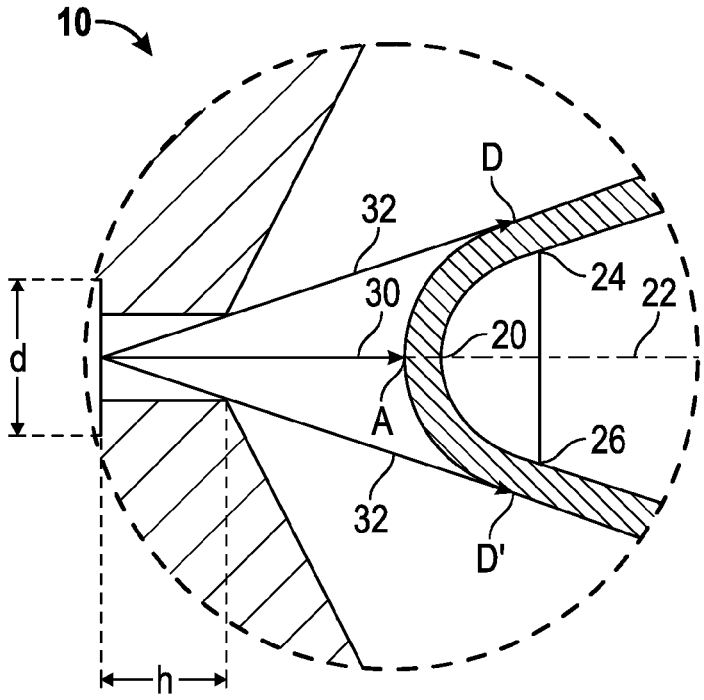
FIG. 1B (Prior Art)
Figure 2:
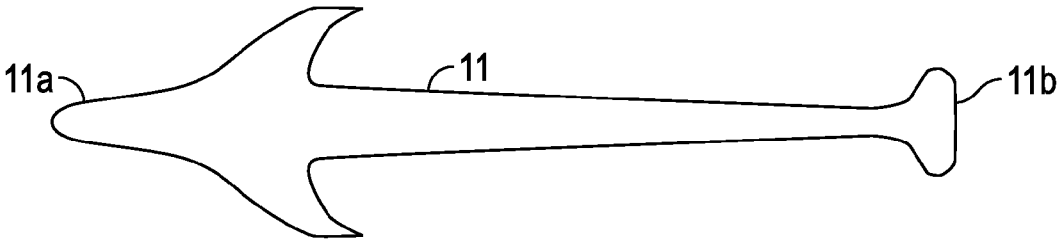
FIG. 2 illustrates a side view of a jet formed by a shaped charge.

Referring now to FIGS. 1A and 1B, there is shown a traditional shaped charge 10 for perforating a subterranean formation. One property of an oilfield shaped charge that is of considerable interest is total target penetration (TTP) in the formation. TTP is the distance a jet formed by the shaped charge penetrates into a formation. Generally speaking, the greater the distance a jet penetrates into the formation, the more fluid will flow out of the perforation. Thus, maximizing TTP can have a significant impact on the amount of hydrocarbons or other fluids produced from a perforated formation. There are many factors that determine TTP, such as the shape, geometry and material composition of a case 12, a liner 14, and explosive materials 16. One factor that can reduce a TTP achieved by the jet is a reverse or negative gradient axial velocity arising during jet formation. The negative gradient axial velocity occurs early in a formation of a jet, an illustrative jet 11 being shown in FIG. 2. That is, a leading portion 11A of the jet 11 can have a velocity lower than a trailing portion 11B of the jet 11. Moreover, the material having a reverse gradient axial velocity comes from an apex region 17 of the liner 14. At least two negative attributes may be associated with a reverse gradient axial velocity: (i) a resistance to later material's axial velocity, and (ii) a waste of liner material.

Based on research performed by the inventors, the liner material located between 0.35 L and 0.5 L has the maximum axial velocity in a jet formed by a traditional shaped charge. The length L is the total length of the liner 14, with the length starting at the liner apex 17 and terminating at a skirt portion 19. Most of the material in the region between 0 L and 0.5 L does not contribute substantially to jet formation. Moreover, since the material between 0 L to 0.5 L does not form the jet, the related high explosive material in that region contributes less to jet formation and jet velocity. The inventors have further perceived that changing the inside case and liner geometries can change the point on the liner from which the maximum axial velocity derives.

As shown in FIG. 1B, the material initially at point 20 will first reach point 22 before the material initially at points 24 and 26 arrives at point 22. Since velocities of the material initially at points 24 and 26 are faster than the velocity of the material initially at point 20, a reverse gradient axial velocity occurs. That is, the slower velocity material of point 20 is ahead of the faster velocity material of points 24 and 26. The mechanics underlying the reverse gradient relates to the different routes a shock wave follows to reach the points 20, 24 and 26. As shown in FIG. 1B, a shock wave generated upon detonation of the shaped charge 10 reaches point 20 through route 30 and propels the material initially at point 20 to point 22. The shock wave also goes through a route 32 to reach points 24 and 26, and propels the material initially at points 24 and 26 to point 22. The speed of the shock wave in HMX explosive is around 9.11 km/sec.

Embodiments of the present design utilize features that reduce the likelihood of a reverse velocity gradient. As will be seen, these features enable jet formation wherein the material having faster axial velocity is positioned ahead of the material having relatively slower axial velocity.

Figure 3:
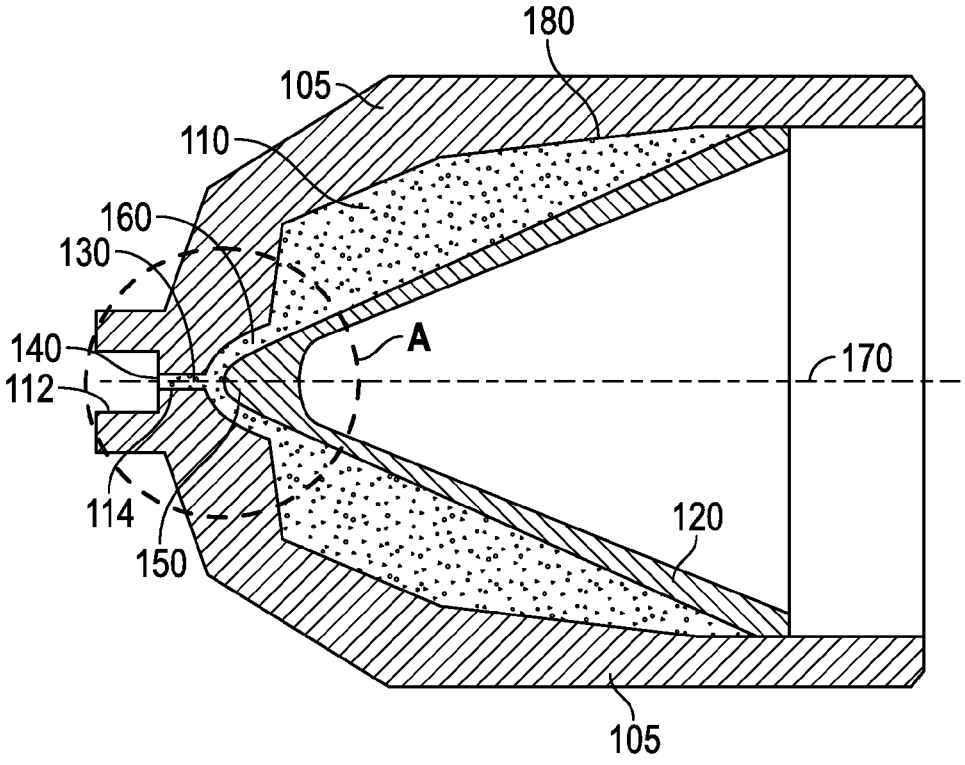
FIG. 3 illustrates one shaped charge made in accordance with the present disclosure.

Referring now to FIG. 3, there is shown one shaped charge 100 made in accordance with the present disclosure. The charge 100 includes a casing 105 having a quantity of explosive material 110 and enclosed by a liner 120. The casing 105 is generally conventional and may be made of materials such as steel and zinc. Other suitable materials include particle or fiber reinforced composite materials. The casing 105 may have a geometry that is symmetric along an axis 170. The shape of the casing 105 may be adjusted to suit different purposes such as deep penetration or large entry hole or both. As is known, the liner geometries can be varied to obtain deep penetration and small entry holes, relatively short penetration depth and large entry holes, or relatively deep penetration and relative large entry holes. The teachings of the present disclosure, however, are not limited to any particular shaped charge design or application.

Figure 4:
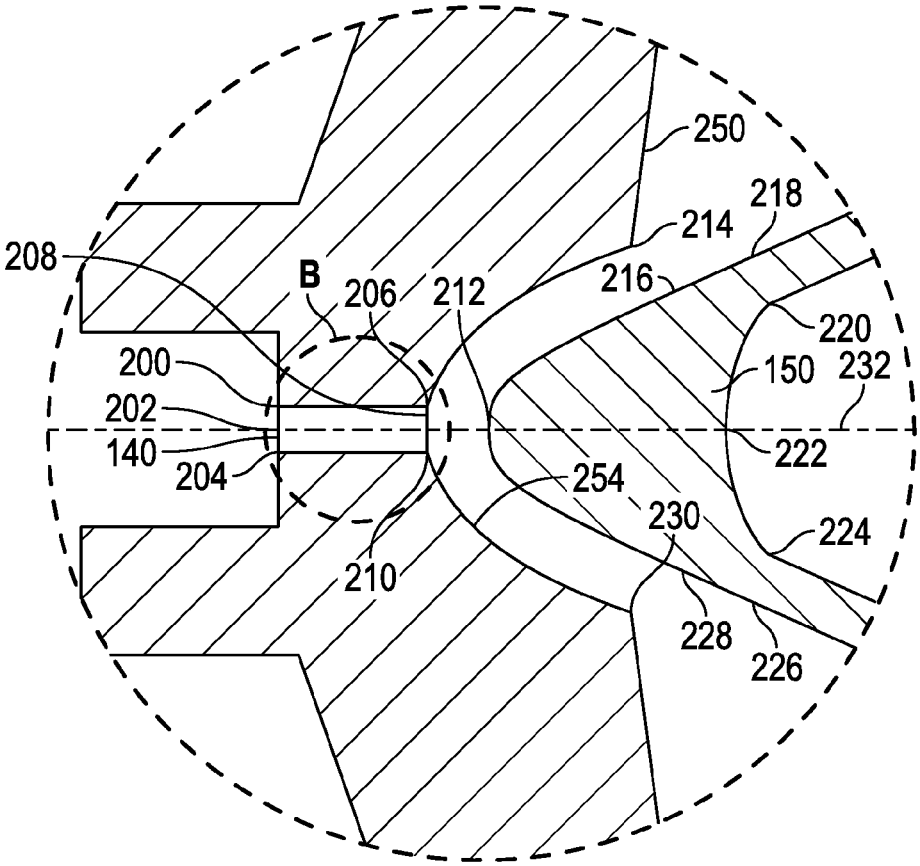
FIG. 4 illustrates the apex region of the FIG. 3 embodiment.

In an exemplary embodiment, the casing 105 includes a slot 112 for receiving a detonator cord (not shown) and a channel or cavity 114 for ballistically coupling the detonator cord (not shown) with the explosive material 110, also referred to herein as a main explosive charge. In embodiments, the shaped charge 100 includes one or more features that control the position and velocity of the material that forms a perforating jet. In one embodiment, the quantity of explosive material adjacent the liner 120 is distributed to reduce the pressure generated by the explosive material in a region proximate to an apex 150 and/or increase the generated pressure at regions adjacent to the apex 150. Referring now to FIG. 4, there is shown a detailed view of the region proximate to the apex 150. FIG. 4 shows an area bounded by the points 200, 204, 210, 230, 228, 216, 214, and 206. The bounded area includes a quantity of explosive material used to initiate detonation. Referring to FIGS. 3 and 4, for illustrative purposes, this quantity of explosive material is shown as initiation charge material 130 and initiation charge material 160. The charge material 130 is positioned in the channel 114. The charge material 160 is positioned in a gap between the surface 250 and a portion of the apex 150. In one arrangement, the gap is defined by a recess 254 formed in the surface 250 that allows an even distribution of explosive material around the apex 150. Thus, the casing 105 may be considered to have a first interior volume having a first quantity of explosive material for forming the jet, and a second interior volume having a second quantity of material for initiating a detonation of the shaped charge 100. In the illustrated example, the second quantity of material includes the initiation charge materials 130 and 160. In some embodiments, the ratio and positioning of the first quantity and second quantity of explosive material are controlled to cause material at the apex 150 to have a lower velocity than the material at other portions during formation of the jet.

In embodiments, the thickness of the initiation charge materials 130 and 160 is minimized to the amount needed to maintain a stable detonation. In some arrangements, the width of the initiation charge materials 130 and 160 can be 0.04~0.09 inch to stably initiate main explosive 110. In one embodiment, the value of the thickness between points 212 and 222 is determined using hydrodynamic code to carry out a numerical simulation, which may yield a minimum thickness value for liner stability. Exemplary factors for performing such computer modeling include the composition of the liner material, the porosity of the apex liner 150, liner geometry and shock wave speed in the region 150. Additionally, the wall thickness of the liner 120 at points 220 and 224 in FIG. 4 should be sufficiently thin to enable a relatively high tip axial velocity. However, the concentricity of the jet tip axial velocity may be sensitive to the wall thickness at points 220 and 224. The concentricity of a detonating wave depends on small booster column 130 and micro structure of the initiation charge material 130 and 160 and the main explosive 110.

Comparing FIG. 1B with FIG. 4, it should be appreciated that the quantity of initiation charge materials 130 and 160 is less than that used in traditional shaped charges. Thus, the initiation charge materials 130 and 160 generate relatively lower peak pressures as compared to the main explosive charge 110. Additionally, the shock wave generated by the initiation charges 130 and 160 is relatively slower. Thus, it should be appreciated that the material at the apex 150 may have a lower velocity than the material adjacent the apex 150, such as points 218 and 226.

Figure 5:
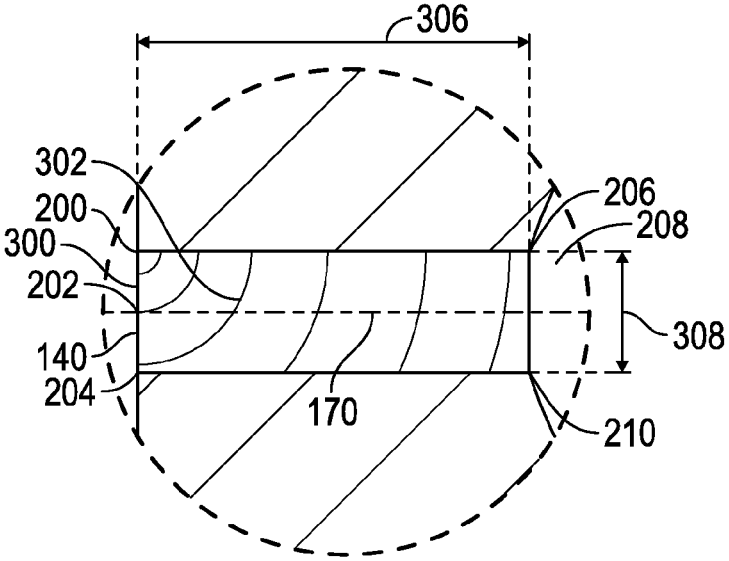
FIG. 5 illustrates a booster column of the FIG. 3 embodiment.

The channel 114 receiving the initiation charge 130 may also be configured to control peak pressure and shock wave velocity. Drift velocity, or lateral velocity, may depend on many factors, such as explosive charge detonation wave and liner concentricity. Referring now to FIG. 5, detonation wave concentricity primarily depends on the geometry of the detonation region and the detonation method. The initiation charge material 130 as shown in FIG. 5 is narrow and long. In some arrangements, the ratio of the diameter 308 to the length 306 is between 0.4 and 0.8. In some applications, the diameter 308 may be between 0.05 inches and 0.09 inches, depending on the size of a shaped charge. Since a detonation cord is usually used to initiate the initiation charge 130, the detonating point is not on the origin point 202, but on an eccentric point 300. When the detonation wave 302 reaches surface 208, the detonation wave 302 becomes a plane perpendicular to the symmetric axis 170. In this way, concentricity of the detonation wave can be reached. Thus, the length 306 may be selected to ensure that the detonation wave can reach concentricity.

Referring still to FIGS. 3 and 4, the apex 150 of the liner 120 is formed to have a thicker cross-section than the cross-section of the adjacent portions of the liner 120. In one arrangement, the distance between point 212 and point 222 is greater than the cross-sectional thickness of any portion of the liner 120. Thus, the mass of the material at the apex 150 is greater than that of conventional shaped charge liners. Accordingly, the velocity reached by the material at the apex 150 is lower than that of conventional shaped charge liners. It should be understood that relatively small increases in relative thicknesses, e.g., five percent or ten percent greater than adjacent thicknesses, may be inadequate to provide sufficient mass to reduce the velocity of the apex material. Rather, the thickness of the apex should be at least fifty percent greater than the thickness of adjacent portions of the liner 120. In embodiments, the cross-sectional thickness of the apex is at least one-hundred percent greater than the thickness of adjacent cross-sectional portions of the liner 120.

In a related aspect, in embodiments, a porous material is used to form the liner 120. Because of the relatively greater thickness at the apex 150, greater pressure can be applied in forming the liner 120. The increased pressure increases the density at the apex 150. Thus, the density of the region of points 220 and 224 may be higher than a density of the apex in traditional shaped charge liners. In other words, the porosity in the region of points 220 and 224 is less than the porosity in a traditional shaped charge liner. Furthermore, the density of the material at the apex 150 is greater than the density of the other portions of the liner 120. Stated another way, the porosity of the material at the apex 150 is less than the porosity of the other portions of the liner 120.

Thus separately or in combination, the distribution of initiation charge material, the mass of the apex, and the density of the material at the apex, cause the shock wave to reach points 220 and 224 before reaching point 222. Therefore, the shock wave will cause the material at points 220 and 224 to reach point 232 before the material at point 222 reaches point 232. As should be appreciated, these mechanisms may reduce, if not eliminate, the reverse velocity gradient.

Figure 6:
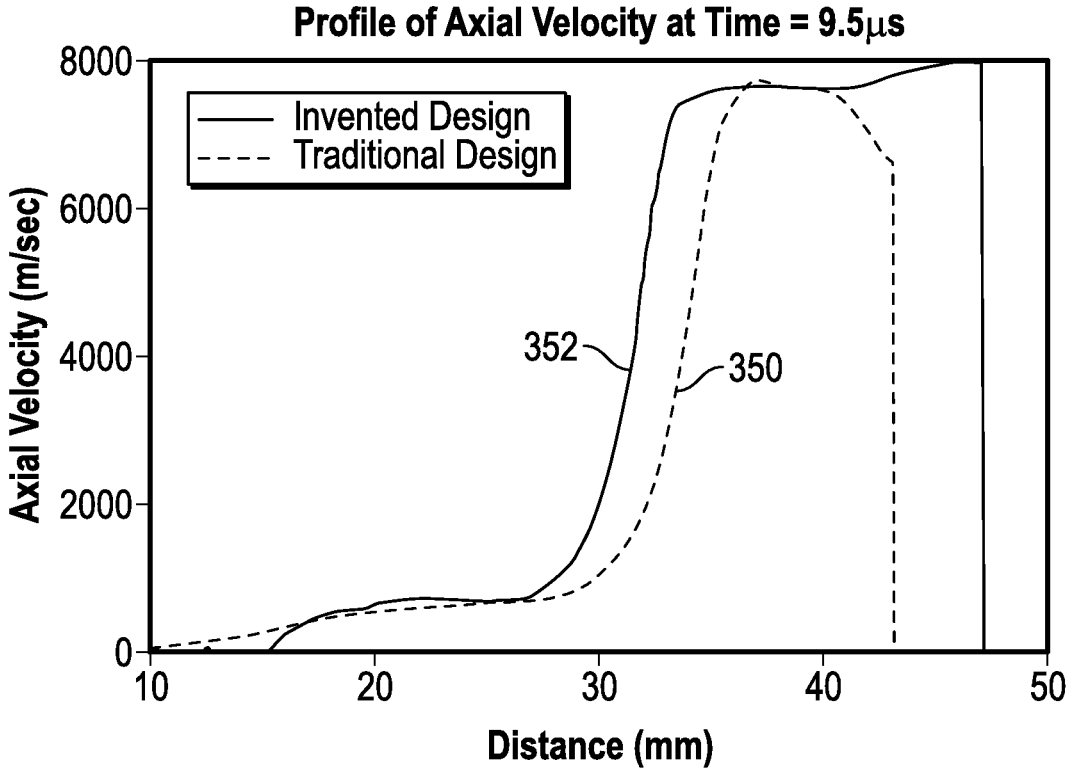
FIG. 6 graphically illustrates a profile of axial velocities for a traditional shaped charge and a shaped charge made in accordance with one embodiment of the present disclosure.

Referring now to FIG. 6, there is shown a graph illustrating results of a computer simulation for a traditional shaped charge and an illustrative shaped charge made in accordance with one embodiment of the present disclosure. Line 350 shows an axial velocity versus distance for the traditional shaped charge and line 352 shows an axial velocity versus distance for one illustrative shaped charge. As can be seen, the illustrative shaped charge has higher tip axial velocity and reaches a point further along the axis than the traditional design at the same time. From FIG. 6, it should also be appreciated that the illustrative shaped charge may have a longer jet than the traditional design.

Utilization of the above-described design for detonation initiation materials 130 and 160 requires less mass explosives than in conventional charges, and may allow the use of more explosives in the main explosive charge 110. Thus, more kinetic energy may be available to form the liner material into a perforating jet.

Figure 7:
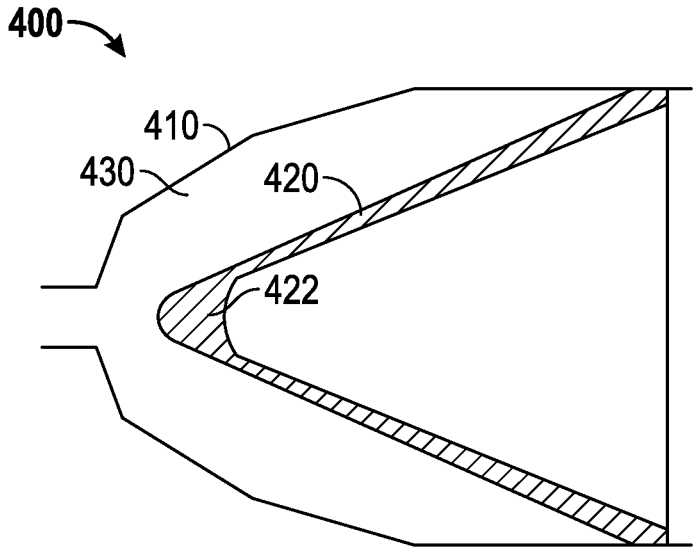
FIG. 7 illustrates another shaped charge made in accordance with the present disclosure.

Embodiments of the present disclosure may also be utilized in connection with a conventional casing design. Referring now to FIG. 7, there is shown a shaped charge 400 having a casing 410, a liner 420, and explosive material 430. The reverse gradient is neutralized by use of an enlarged apex region 422. As discussed previously, the apex region 422 has either or both of (i) a thickness greater than the other portions of the liner 420, and (ii) a density greater than the other portions of the liner 420. The casing 410 does not include a recess similar to the recess 254 of FIG. 4.

It should be appreciated that new methods of manufacture can also be utilized to form shaped charges in accordance with embodiments of the present disclosure. The liner material may be selected from a wide array of metallic powders or metal powder mixtures. Generally, we may select whose metal powders which have higher density, high melt temperature, and high bulk speed of sound. Practically, a heavy powder, such as tungsten powder, is chosen to be main component, and other metal powder, such as lead, copper, molybdenum, aluminum as well as small amount of graphite powder are chosen to be binders.

Figure 8:
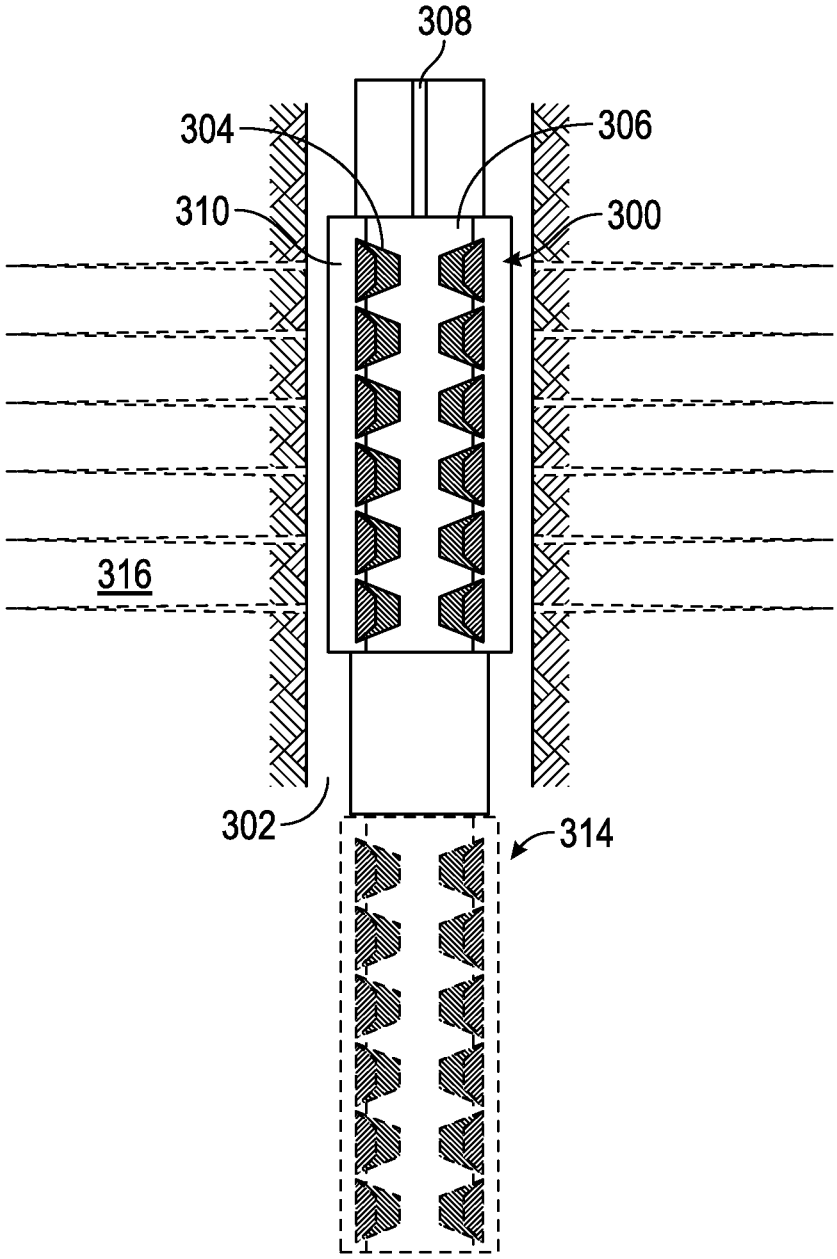
FIG. 8 illustrates a perforating gun utilizing shaped charges made in accordance with the present disclosure.

Referring now to FIG. 8, there is shown a perforating gun 300 disposed in a wellbore 302. Shaped charges 304 are inserted into and secured within a charge holder tube 306. The shaped charges 304 include a liner having an enlarged apex and/or an apex that has a relatively high density, such as that shown in FIGS. 3 and 7. A detonator or primer cord 308 is operatively coupled in a known manner to the shaped charges 304. The charge holder tube 306 with the attached shaped charges 304 are inserted into a carrier housing tube 310. Any suitable detonating system may be used in conjunction with the perforating gun 300 as will be evident to a skilled artisan. The perforating gun 300 is conveyed into the wellbore 302 with a conveyance device that is suspended from a rig or other platform (not shown) at the surface. Suitable conveyance devices for conveying the perforating gun 300 downhole include coiled tubing, drill pipe, a wireline, slick line, or other suitable work string may be used to position and support one or more guns 300 within the well bore 302. In some embodiments, the conveyance device can be a self-propelled tractor or like device that move along the wellbore. In some embodiments, a train of guns may be employed, an exemplary adjacent gun being shown in phantom lines and labeled with 314.

Referring now to FIGS. 2, 3, 7 and 8, during deployment, the perforating gun 300 is conveyed into the wellbore 302 and positioned next to a formation 316 to be perforated. Upon detonation, shock waves travel through the liner and form the liner into a perforating jet. Advantageously, the enlarged apex, which may be more dense that the adjacent portion of liner, forms a portion of the jet that does not have a velocity greater than that of the remainder of the jet. That is, a neutral or positive velocity gradient is maintained in the jet. Thus, the jet maintains a more cohesive structure and greater overall velocity, which may result in deeper penetration into the adjacent formation 316.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

The invention claimed is:

1. A method of perforating a subterranean formation, comprising:

conveying at least one shaped charge into a wellbore penetrating the formation, the shaped charged including a casing, an explosive material in the casing, and a liner enclosing the explosive material within the casing, the liner including an apex portion having a cross-sectional thickness greater than a cross-sectional thickness of any other portion of the liner, the liner and the apex portion being formed of a powdered material, wherein a material density of the apex portion is greater than the material density of an adjacent portion of the liner, and wherein a material porosity of the apex portion is less than the material porosity of the adjacent portion of the liner; and detonating the shaped charge.

2. The method according to claim 1 wherein the cross-sectional thickness of the apex portion is at least fifty percent thicker than a cross-section of a liner portion adjacent the apex portion.

3. The method according to claim 2 wherein the liner has an axial length L, and wherein the liner includes a first region having the apex portion and a second region having a skirt portion, wherein the first region and the second region each make up substantially one-half of the axial length of the liner; and wherein the first region has more mass than the second region.

4. The method according to claim 1 wherein a material density of the apex portion is greater than the material density of any other portion of the liner.

5. The method according to claim 1, wherein the explosive material adjacent to the liner is distributed to reduce a pressure generated in a region proximate to the apex.

6. The method according to claim 1 further comprising conveying the shaped charge in the wellbore using one of: (i) a coiled tubing, (ii) a drill pipe, (iii) a wireline, and (iv) a slick line.

* * * * *